United States Patent [19]

Zei

[11] Patent Number: 4,622,623

[45] Date of Patent: Nov. 11, 1986

[54] LUMINOUS SIGNALLING PLATE, PARTICULARLY SUITABLE FOR THE INSTALLATION ON THE DECK OF A SHIP

[75] Inventor: Dino Zei, Florence, Italy

[73] Assignee: Officine Panerai S.r.l., Florence, Italy

[21] Appl. No.: 708,114

[22] Filed: Mar. 5, 1985

Related U.S. Application Data

[63] Continuation of Ser. No. 483,503, Apr. 11, 1983, abandoned.

[30] Foreign Application Priority Data

Apr. 21, 1982 [IT] Italy ..... 48264 A/82

[51] Int. Cl.[4] ..... F21V 9/16

[52] U.S. Cl. ..... 362/84; 362/249; 362/255; 362/267; 362/368; 340/954

[58] Field of Search ..... 362/61, 84, 311, 364, 362/369, 153, 158, 249, 267, 365, 255, 367, 368; 340/953, 954, 955

[56] References Cited

U.S. PATENT DOCUMENTS

| | | | |
|---|---|---|---|
| Re. 29,266 | 6/1977 | Hessemer et al. | 362/386 |
| 1,853,321 | 4/1932 | Rogers | 340/953 X |
| 2,038,506 | 4/1936 | Cadieux | 340/953 X |
| 2,170,338 | 8/1939 | Plummer et al. | 340/953 X |
| 2,702,862 | 2/1955 | Finney | 362/84 X |
| 2,910,792 | 11/1959 | Pfaff | 362/84 X |
| 2,953,684 | 9/1960 | Machutchin et al. | 362/84 |
| 3,056,897 | 10/1962 | Knochel et al. | 362/367 X |
| 3,096,024 | 7/1963 | Young | 362/364 X |
| 3,096,458 | 7/1963 | Demmy | 362/267 |
| 3,262,224 | 7/1966 | Hardesty | 362/84 X |
| 3,279,406 | 10/1966 | Ricketts et al. | 340/955 |
| 3,317,722 | 5/1967 | Whitney | 362/84 X |
| 3,353,050 | 11/1967 | Panerai et al. | 313/108 |
| 3,354,554 | 11/1967 | Panerai et al. . | |
| 3,535,504 | 10/1970 | Beal et al. | 362/364 X |
| 3,689,757 | 9/1972 | Vilshammer | 362/364 |
| 3,866,032 | 2/1975 | Veres | 362/259 |
| 4,112,485 | 9/1978 | Sutter | 362/369 |
| 4,134,007 | 1/1979 | Koreicho et al. | 362/308 X |
| 4,138,620 | 2/1979 | Dickson | 362/84 X |
| 4,259,658 | 3/1981 | Basov et al. | 340/953 X |
| 4,382,274 | 5/1983 | DeBacker et al. | 362/364 X |

FOREIGN PATENT DOCUMENTS

| | | |
|---|---|---|
| 2054733 | 5/1971 | Fed. Rep. of Germany . |
| 2557821 | 7/1976 | Fed. Rep. of Germany . |
| 2835347 | 2/1980 | Fed. Rep. of Germany . |
| 3235895A1 | 4/1983 | Fed. Rep. of Germany . |

*Primary Examiner*—Craig R. Feinberg
*Assistant Examiner*—David A. Okonsky
*Attorney, Agent, or Firm*—Fitch, Even, Tabin & Flannery

[57] ABSTRACT

A luminous signalling plate, comprising one or more electroluminescent flat units, interchangeably and tightly fitted within a housing, which in turn is fixed on the deck of a ship, flush with the coating of the deck itself.

8 Claims, 10 Drawing Figures

Fig. 9
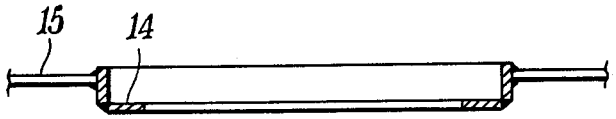
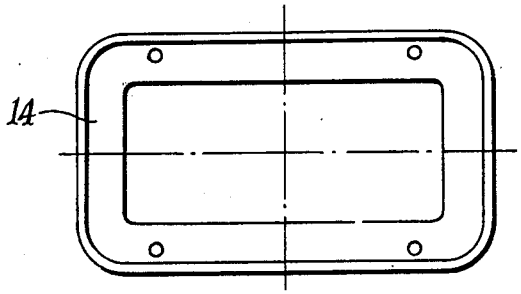
Fig. 8
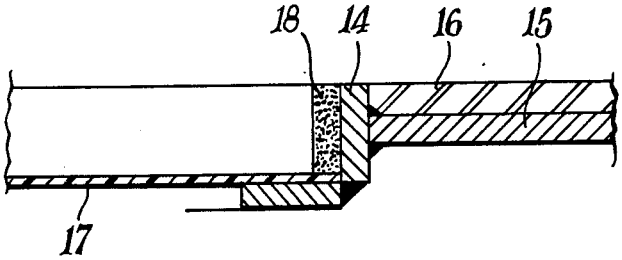
Fig. 10

LUMINOUS SIGNALLING PLATE, PARTICULARLY SUITABLE FOR THE INSTALLATION ON THE DECK OF A SHIP

This application is a continuation of application Ser. No. 483,503 filed Apr. 11, 1983, now abandoned.

BACKGROUND OF THE INVENTION

This invention relates to a luminous signalling device. More particularly, the invention refers to a luminous signalling plate, particularly useful for the installation on the deck of ships.

It is an object of this invention, to provide a light source adapted to signal the outline of the deck and/or operatively important zones on this latter, such as the flying-on-deck areas of airplane or copter carriers, which is distinguished from the ones known. The device of the invention has better operating features, reduced overall dimensions, and higher reliability features, even in the most severe operating conditions.

The light sources heretofore known are formed by one or more filament lamps, positioned, together with their lamp holders, in a housing equipped with a transparent screen. Such a housing is of somewhat great overall dimensions, and entails some problems in respect of the dissipation of the heat produced by the lamps, since the housing must be hermetically tight.

Moreover, the filament lamps have a high electrical input, a limited average life, and a low resistance to shocks and vibrations, except in the case that expensive and complicated anti-shock and anti-vibration devices are provided.

According to the invention, the light source is formed by one or more electroluminescent units, mounted within a support having suitable features, and protected by an upper transparent screen.

The electroluminescent units, already known, for example, from U.S. Pat. Nos. 3,353,050 and 3,354,554, consist in a conductive sheet on which a layer of phosphor is spread, which in turn is coated with a transparent conductive layer. The input voltage is applied between the transparent coating and the conductive sheet, so that the electroluminescence of the phosphor takes place.

Such transparent coating and conductive sheet have a combined thickness of the order of one millimeter, do not develop heat ("cold light"), have a very low electrical power consumption (about 0.1 mA/cm max), have a life of several thousands of hours, and are intrinsically shock and vibration resistant.

The electroluminescent units, properly fed, show a lighting power sufficient to render the same visible at a distance of the order of one thousand meters in standard atmosphere, and the light emitted therefrom may be colored in green, orange, blue or white.

The invention will be now described with reference to the accompanying drawings which show by way of a non-limiting example a preferred embodiment of the invention itself.

In the drawings:

FIGS. 8 and 9 show a single-unit supporting frame, in plan view and longitudinal sectional view, respectively;

FIG. 10 shows the mounting of the plate and supporting frame therefor on the flight deck.

Figure 2:
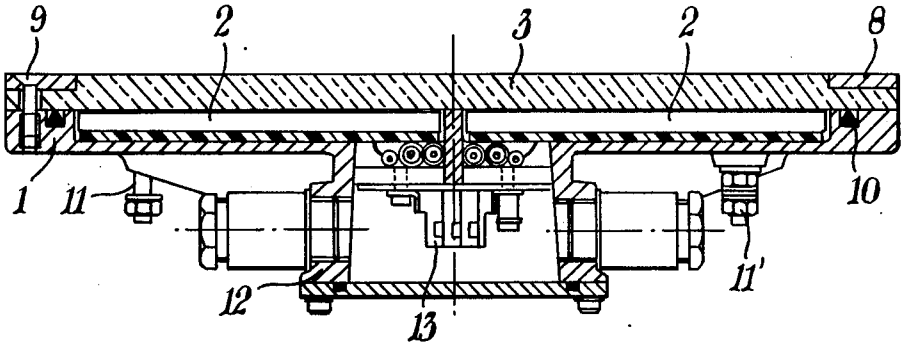
FIG. 2 is a cross-sectional view taken along the plane II—II of FIG. 1.
Figure 1:
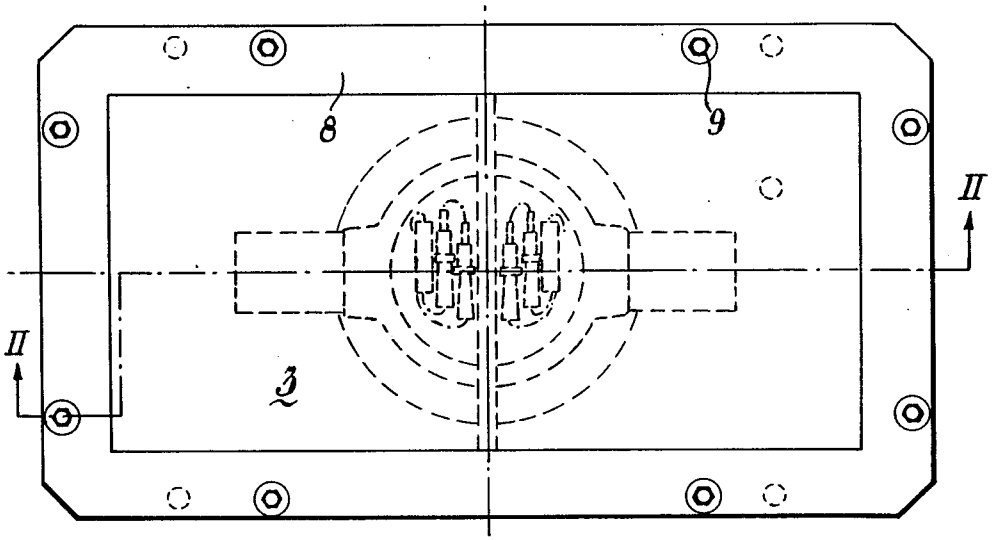
FIG. 1 is a front elevation view of the luminous plate according to the invention.

Referring now to FIGS. 1 and 2, the luminous plate according to this invention comprises a light alloy housing 1, in which two flat electroluminescent light sources 2 are contained, protected by an upper transparent screen 3 having suitable mechanical features.

Figure 3:
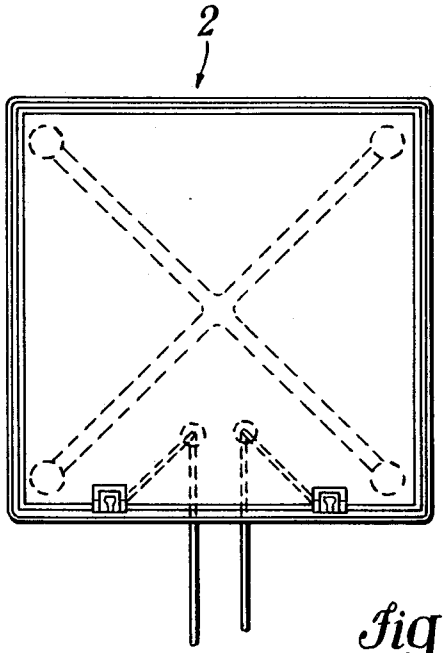
FIG. 3 shows an electroluminescent unit, in front elevation view.
Figure 5:
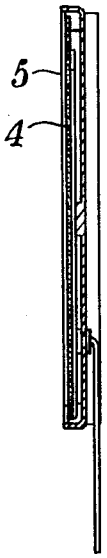
FIG. 5 is a sectional view taken along the plane V—V of FIG. 4.
Figure 4:
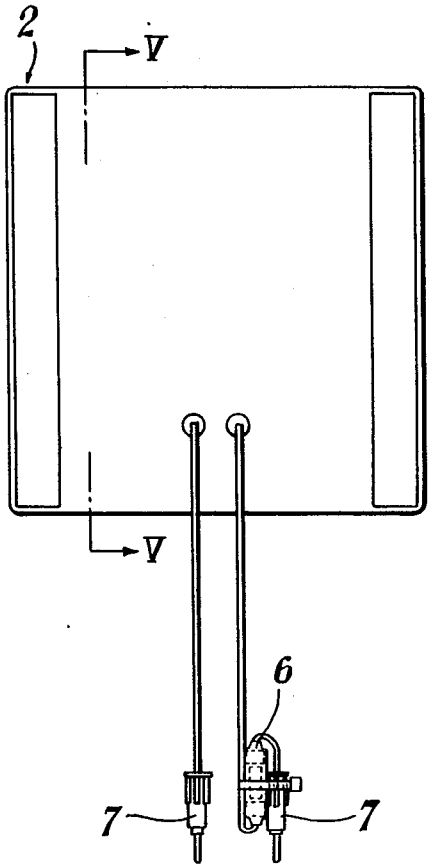
FIG. 4 is the rear elevation view of the unit of FIG. 3.
Figure 6:
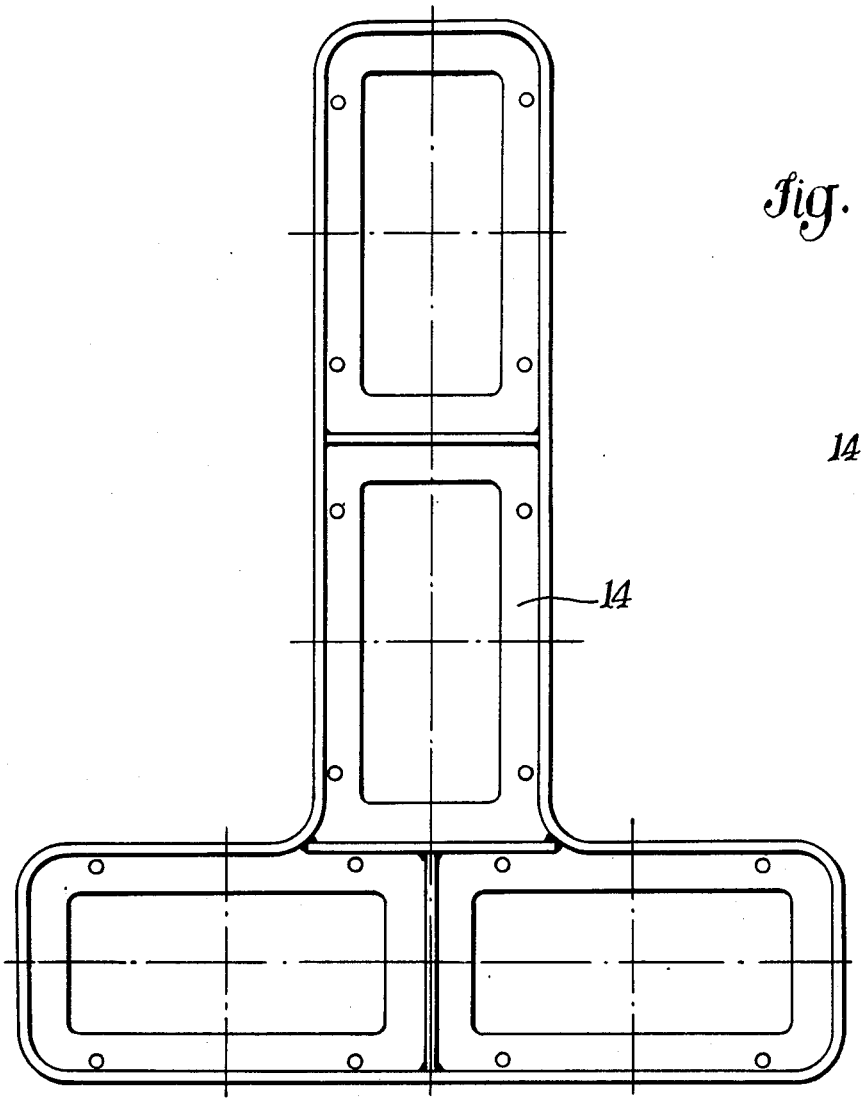
FIG. 6 is a plan view of a supporting frame for electroluminescent plates according to the invention positioned so as to form a T.
Figure 7:
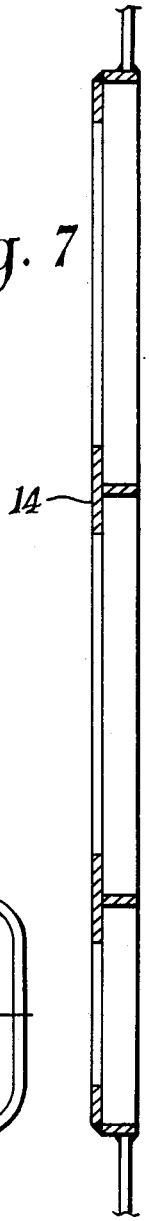
FIG. 7 is a longitudinal sectional view, corresponding to FIG. 6.

Each luminous source 2 (see also FIGS. 3, 4, and 5) is formed by electroluminescent unit 4, embedded in a plastic envelope 5 for ready mounting, equipped with a protection fuse 6 and a pair of movable connectors 7 for the electrical circuitry.

The upper transparent screen is fixed to the light alloy housing 1 by means of a frame 8 and a set of loose-proof fastening screws 9 made of stainless steel, with an interposed gasket 10.

The light alloy housing 1 bears in the lower part four stud bolts 11 of stainless steel, for fastening the plate on the ship deck, as it will be described hereinafter, and a built-in connection block 12 for the electrical connection of the various plates, containing suitable terminal board 13, and two sealed passages. The housing is also equipped with a ground clamp 11'.

The plates are embedded in the deck, usually spaced along a line, or in groups of four elements, so as to form a T, and so on.

In the FIGS. 6 to 9 the flush fastening system on the deck of the ship is shown. The system comprises a supporting frame 14, having the desired outline (such as the "T" form of FIG. 6, and the single unit of FIG. 8) which is welded on the flight deck 15 (FIG. 10) so as to be in the same level of the covering 16 of the deck itself. The electroluminescent plate is positioned in the frame 14, and is fixed by means of stud bolts 11 of the housing, with an interposed sealing gasket 17.

The cavity 18 between the plate and the frame 14 is filled with a casting of a sealing elastomeric material, up to the level of the upper rim of the plate.

In case of failure of one of the electroluminescent units, the replacement of the same is quite easy and quick, by simply unscrewing the screws 9, removing the transparent cover, and disconnecting the movable connectors thereof.

The present invention has been disclosed with reference to a preferred embodiment thereof, but it shall be understood that many modifications and variations could be accomplished by those skilled in the art, without departing from the scope of the invention as defined by the appended claims.

What is claimed is:

1. A luminous signalling plate for runways on ship decks, comprising a shallow housing having an open face;

at least one flat electroluminescent element replaceably mounted within said housing;

a transparent screen removably mounted from the flat electroluminescent elements mounted on the housing over the flat electroluminescent element and enclosing the open face of the housing;

means making the enclosing of the open face hermetically tight;

means on said housing for mounting said signalling plate in a ship deck flush therewith; and electric connection means for connecting said electroluminescent element to an electric current source.

2. A luminous signalling plate as claimed in claim 1, wherein said means making the enclosing of the open face hermetically tight includes gasket means forming a seal between said transparent screen and said housing tightly closing said electroluminescent element within said housing and further comprising a seat in said housing receiving said electroluminescent element;

a peripheral recess provided on said transparent screen;

a frame complementary to said recess in said screen and inserted in said recess to mount said screen on said frame, said frame when so inserted being flush with said screen;

screw means fastening said frame and said transparent screen to said housing; and an outer supporting frame for embedding in the ship deck and receiving said housing when so embedded in the ship deck.

3. A luminous signalling plate as claimed in claim 2, wherein said outer supporting frame has a seat for receiving said housing and is welded to the ship deck when so embedded therein; wherein said means on said housing for mounting said signalling plate includes a plurality of stud bolts for fastening said housing to said outer supporting frame; and further including sealing means being interposed between said stud bolts and said outer supporting frame, and sealing material provided in any free space between said housing and said supporting frame.

4. A luminous signalling plate as claimed in claim 1 wherein the replaceably mounted flat electroluminescent element further includes a plastic envelope in which the element is embedded forming a unit for ready mounting and removal, and a pair of movable electrical connectors attached by leads to the electroluminescent element, the leads extending outwardly through the plastic envelope to the connectors.

5. A luminous signalling plate as claimed in claim 4 further including a protection fuse provided in series with at least one of the movable connectors.

6. A luminous signalling plate for runways on ship decks, comprising a shallow housing having an open face;

a light source including at least one flat electroluminescent element, a plastic envelope in which the electroluminescent element is embedded forming a unit, and a pair of movable electric connectors attached by leads to the electroluminescent element, the leads extending outwardly through the plastic envelope to the connectors, the light source unit being replaceably mounted within said housing;

a transparent screen removably mounted from the flat electroluminescent element and mounted on the housing over the light source and enclosing the open face of the housing;

means making the enclosing of the open face hermetically tight;

means on said housing for mounting said signalling plate in a ship deck flush therewith; and electric connection means for connecting the movable connectors of said light source to an electric current source.

7. A luminous signalling plate as claimed in claim 6, wherein said means making the enclosing of the open face hermetically tight includes gasket means forming a seal between said transparent screen and said housing tightly closing said electroluminescent element within said housing and further comprising a seat in said housing receiving said electroluminescent element;

a peripheral recess provided on said transparent screen;

a frame complementary to said recess in said screen and inserted in said recess to mount said screen on said frame, said frame when so inserted being flush with said screen;

screw means fastening said frame and said transparent screen to said housing; and an outer supporting frame for embedding in the ship deck and receiving said housing when so embedded in the ship deck.

8. A luminous signalling plate as claimed in claim 7, wherein said outer supporting frame has a seat for receiving said housing and is welded to the ship deck when so embedded therein; wherein said means on said housing for mounting said signalling plate includes a plurality of stud bolts for fastening said housing to said outer supporting frame; and further including sealing means being interposed between said stud bolts and said outer supporting frame, and sealing material provided in any free space between said housing and said supporting frame.

* * * * *

UNITED STATES PATENT AND TRADEMARK OFFICE

CERTIFICATE OF CORRECTION

PATENT NO. : 4,622,623

DATED : November 11, 1986

INVENTOR(S) : Dino ZEI

It is certified that error appears in the above-identified patent and that said Letters Patent is hereby corrected as shown below:

Col. 1, Line 50, change "cm max" to --$cm^2$max--.

Col. 2, Line 24, after "screen" insert --3--.

Col. 2, Line 68, change "elements" to --element and--.

Signed and Sealed this

Fourteenth Day of April, 1987

*Attest:*

DONALD J. QUIGG

*Attesting Officer*

*Commissioner of Patents and Trademarks*